US007478448B2

(12) United States Patent
Boso et al.

(10) Patent No.: US 7,478,448 B2
(45) **Date of Patent: *Jan. 20, 2009**

(54) INFLATABLE REINFORCING CHAMBER

(75) Inventors: Karen L. Boso, Woodstock, IL (US); Chen Ching-Chin, Taipei (TW)

(73) Assignee: Aero Products International, Inc., Schaumburg, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/644,128

(22) Filed: Dec. 22, 2006

(65) Prior Publication Data

US 2007/0169274 A1 Jul. 26, 2007

Related U.S. Application Data

(60) Continuation-in-part of application No. 11/233,645, filed on Sep. 23, 2005, now Pat. No. 7,165,283, which is a division of application No. 10/751,783, filed on Jan. 5, 2004, now Pat. No. 6,996,867, which is a continuation of application No. 09/918,561, filed on Aug. 1, 2001, now Pat. No. 6,701,559.

(60) Provisional application No. 60/760,657, filed on Jan. 20, 2006.

(51) Int. Cl.
*A47C 27/10* (2006.01)

(52) U.S. Cl. ..... 5/739; 5/711; 5/713

(58) Field of Classification Search ..... 5/706, 5/710–713, 739, 424, 732
See application file for complete search history.

(56) References Cited

U.S. PATENT DOCUMENTS

| | | | |
|---|---|---|---|
| 388,037 | A | 8/1888 | Hargin |
| 625,114 | A | 5/1899 | MacSpadden |
| 679,519 | A | 7/1901 | Smith |
| 918,391 | A | 4/1909 | Taarud |
| 1,185,684 | A | 6/1916 | Kraft et al. |
| 1,263,599 | A | 4/1918 | Poole |
| 1,451,136 | A | 4/1923 | Allnutt |
| 1,576,211 | A | 3/1926 | O'Kane |
| 1,944,466 | A | 1/1934 | Rubin |
| 2,059,226 | A | 11/1936 | Gates |
| 2,064,695 | A | 12/1936 | Sipe |

(Continued)

FOREIGN PATENT DOCUMENTS

| | | |
|---|---|---|
| EP | 0 317 021 | 5/1989 |

(Continued)

OTHER PUBLICATIONS

International Search Report from Corresponding International Application No. PCT/US2007/086909, dated Jun. 10, 2008, 10 pages.

*Primary Examiner*—Michael Trettel
(74) *Attorney, Agent, or Firm*—Brinks Hofer Gilson & Lione

(57) ABSTRACT

An inflatable mattress. The inflatable mattress comprises a support system having upper and lower inflatable support chambers arranged in a substantially vertical manner. Each inflatable support chamber comprises a top layer and a bottom layer. The inflatable mattress further comprises an inflatable reinforcing chamber disposed between the upper and lower inflatable support chambers and attached to the lower inflatable support chamber.

17 Claims, 9 Drawing Sheets

U.S. PATENT DOCUMENTS 2,112,641 A 3/1938 Wheaton
2,288,889 A 7/1942 Costello
2,369,736 A 2/1945 Hurt
2,372,218 A 3/1945 Manson et al.
2,415,150 A 2/1947 Stein
2,549,597 A 4/1951 Harris et al.
2,573,375 A 10/1951 Winstead
2,604,641 A * 7/1952 Reed ..... 5/710
2,614,272 A * 10/1952 Morner ..... 5/655.3
2,672,628 A 3/1954 Spanel
2,701,579 A 2/1955 Hasselquist
2,703,770 A 3/1955 Melzer
2,741,780 A 4/1956 Kimbrig
2,767,735 A 10/1956 Darling
2,842,783 A 7/1958 Druck
2,949,927 A 8/1960 Mackal
3,026,909 A 3/1962 Boteler
3,042,941 A 7/1962 Marcus
3,068,494 A 12/1962 Pinkwater
3,099,386 A 7/1963 Pieper
3,123,336 A 3/1964 Price
3,128,480 A 4/1964 Lineback
3,142,850 A 8/1964 De Boer
3,155,991 A 11/1964 Dunham
3,208,721 A 9/1965 McHugh
3,403,696 A 10/1968 Pynchon
3,505,695 A 4/1970 Bishaf et al.
3,511,472 A 5/1970 Zimmerman
3,536,071 A 10/1970 Ferrando
3,563,676 A 2/1971 Coovert et al.
3,600,727 A 8/1971 Williams
3,772,717 A 11/1973 Yuen et al.
3,785,395 A 1/1974 Andreasson
3,790,975 A 2/1974 Philipp et al.
3,798,686 A 3/1974 Gaiser
3,831,628 A 8/1974 Kinter et al.
3,840,922 A 10/1974 Morrison et al.
3,864,766 A 2/1975 Prete, Jr.
3,877,092 A 4/1975 Gaiser
3,973,588 A 8/1976 Holst
3,983,907 A 10/1976 Sorensen
3,995,653 A 12/1976 Mackal et al.
4,025,974 A 5/1977 Lea et al.
4,078,580 A 3/1978 Rudle
4,080,105 A 3/1978 Connell
4,091,482 A 5/1978 Malcolm
4,099,773 A 7/1978 Chang
4,146,069 A 3/1979 Angarola et al.
4,146,070 A 3/1979 Angarola et al.
4,149,285 A 4/1979 Stanton
4,169,295 A 10/1979 Darling
4,176,681 A 12/1979 Mackal
4,225,989 A 10/1980 Corbett et al.
4,371,999 A 2/1983 Reid
4,442,838 A 4/1984 Samson et al.
4,478,587 A 10/1984 Mackal
4,488,323 A 12/1984 Colburn
4,521,166 A 6/1985 Phillips
4,579,141 A 4/1986 Arff
4,594,743 A 6/1986 Owen et al.
4,644,597 A 2/1987 Walker
4,678,014 A 7/1987 Owen et al.
4,712,574 A 12/1987 Perrott
4,734,017 A 3/1988 Levin
4,766,628 A 8/1988 Walker
4,815,153 A 3/1989 Bleser et al.
4,829,616 A 5/1989 Walker
4,862,533 A 9/1989 Adams, III
4,890,344 A 1/1990 Walker
4,896,389 A 1/1990 Chamberland
4,897,890 A 2/1990 Walker
4,970,741 A 11/1990 Spina
4,977,633 A 12/1990 Chaffee
4,982,466 A 1/1991 Higgins et al.
5,052,894 A 10/1991 Rimington
5,068,933 A 12/1991 Sexton
5,079,785 A 1/1992 Garcia
5,109,560 A 5/1992 Uetake
5,111,838 A 5/1992 Langston
5,117,517 A 6/1992 Su
5,163,196 A 11/1992 Graebe et al.
5,170,522 A 12/1992 Walker
D343,980 S 2/1994 Torchia
5,343,889 A 9/1994 Jaw
5,367,726 A 11/1994 Chaffee
5,493,742 A 2/1996 Klearman
5,598,593 A * 2/1997 Wolfe ..... 5/710
5,689,845 A 11/1997 Sobieralski
5,746,873 A 5/1998 Graf
5,903,941 A 5/1999 Shafer et al.
D414,976 S 10/1999 Su et al.
5,960,495 A 10/1999 Hsu et al.
5,963,997 A 10/1999 Hagopian
6,009,580 A 1/2000 Caminade et al.
6,076,214 A 6/2000 Klimenko
6,108,844 A 8/2000 Kraft et al.
6,131,219 A 10/2000 Roberts
6,161,902 A 12/2000 Lieberman
6,189,168 B1 2/2001 Graebe
6,240,584 B1 6/2001 Perez et al.
6,287,095 B1 9/2001 Saputo et al.
6,446,289 B1 9/2002 Su et al.
6,483,264 B1 11/2002 Shafer et al.
6,701,559 B2 * 3/2004 Boso et al. ..... 5/739
6,998,867 B1 * 2/2006 Merwah ..... 324/765
7,165,283 B2 * 1/2007 Boso et al. ..... 5/739
2001/0044969 A1 11/2001 Chaffee
2002/0116765 A1 8/2002 Smith et al.
2002/0184710 A1 12/2002 Chaffee
2002/0194678 A1 12/2002 Chung
2003/0024050 A1 2/2003 Boso et al.
2003/0028971 A1 2/2003 Chaffee
2003/0101516 A1 6/2003 Hsu et al.
2003/0192123 A1 10/2003 Chaffee
2003/0200610 A1 10/2003 Wang
2003/0200611 A1 10/2003 Chaffee
2004/0194219 A1 10/2004 Boso et al.

FOREIGN PATENT DOCUMENTS

GB 841 736 7/1960
GB 2 050 844 1/1981
IT 359340 2/1938
WO WO 93/05684 4/1993
WO WO 2005/117658 A1 12/2005

* cited by examiner

Fig. 3
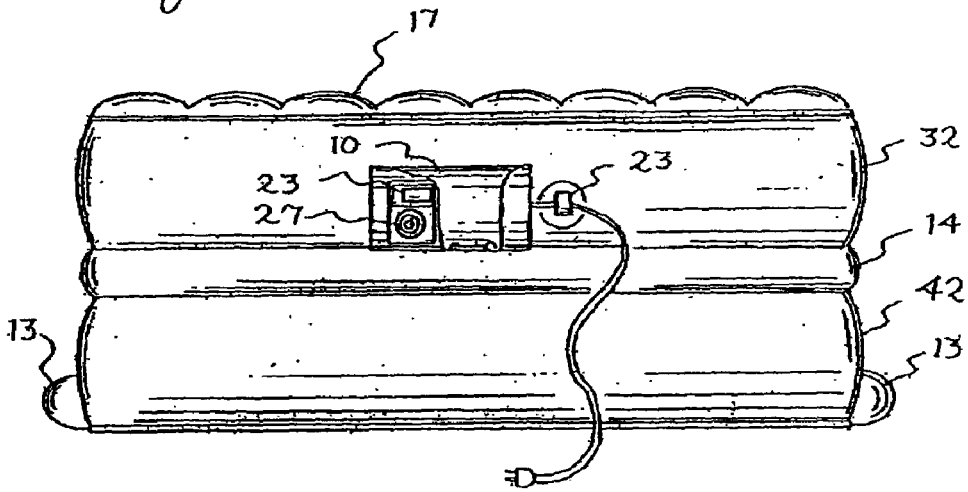
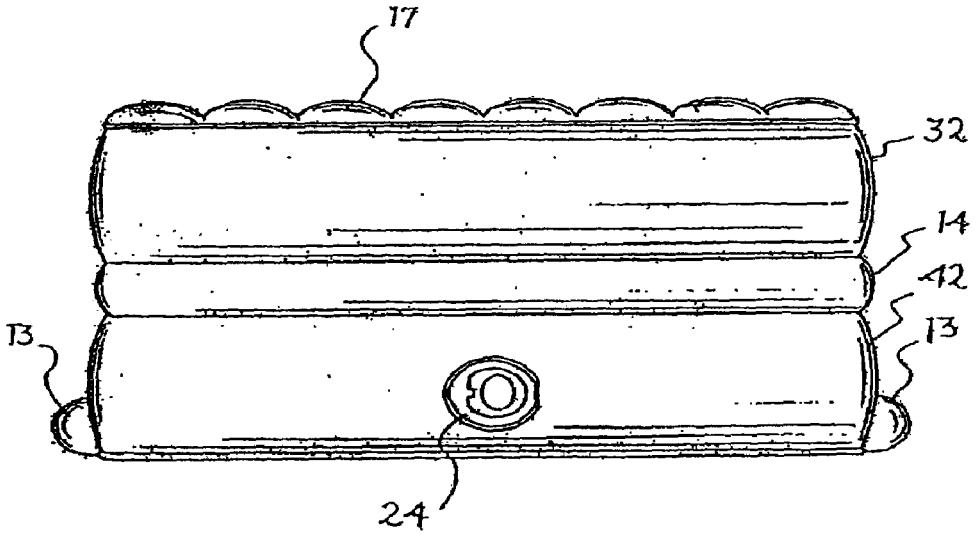
Fig. 4

INFLATABLE REINFORCING CHAMBER

RELATED APPLICATIONS

The present patent application claims priority to U.S. Provisional Patent Application No. 60/760,657, filed Jan. 20, 2006 and is a Continuation-In-Part of U.S. patent application No. 11/233,645, filed Sep. 23, 2005 and now U.S. Pat. No. 7,165,283, which is a divisional of application Ser. No. 10/751,783, now U.S. Pat. No. 6,996,867, filed Jan. 5, 2004 and now U.S. Pat. No. 6,996,867, which in turn is a continuation of application Ser. No. 09/918,561, now U.S. Pat. No. 6,701,559 filed Aug. 1, 2001 and now U.S. Pat. No. 6,701,559, the entire disclosures of which are hereby incorporated by reference.

FIELD OF THE INVENTION

The present invention relates generally to the field of inflatable support systems, which may include air mattresses and inflation controls thereof. More specifically, the present invention relates to an inflatable reinforcing chamber for use in conjunction with an increased height inflatable support system.

BACKGROUND OF THE INVENTION

Most everyone has faced the need for an extra bed or mattress at some time in their life. Air mattresses, originally introduced many years ago, have allowed homeowners and others to provide their guests with a surface more comfortable than sleeping on the floor, while not imposing the same storage requirements as traditional mattresses.

While air mattresses are a significant improvement over sleeping on the ground or curled up on a sofa, the mattresses still have many problems. For example, air mattress designs were clunky and uncomfortable, the manufacturing techniques and materials used resulted in poor air retention, the inflation and deflation systems employed with such mattresses often required significant time and effort, and the mattresses tended to provide only marginal support.

Some issued patents, such as U.S. Pat. No. 4,977,633, issued to Robert B. Chaffee on Dec. 18, 1990 ("the Chaffee patent"), and U.S. Pat. No. 5,960,495, issued to Yaw-Yuan Hsu, et al. on Oct. 5, 1999 ("the Hsu patent"), have attempted to address some of these shortcomings. By way of example, the Chaffee patent teaches the use of a large, manually operated pressure release valve to speed deflation. The Chaffee patent also teaches the inclusion of a small cylinder around which a deflated bed can be rolled, further simplifying deflation. This same arrangement also allows the bed to automatically unroll while being inflated, which also simplifies the inflation process. The Chaffee patent also illustrates the inclusion of an electric motor, which speeds the inflation process.

The Hsu patent attempts to address some of the comfort problems typically associated with air mattresses. The Hsu patent utilizes tube beams inside a mattress to provide additional lateral load support. These tube beams are separate structures which are added to the inside of the mattress and are attached to the upper and lower mattress surfaces through a sinusoidal sealing pattern in an attempt to provide further rigidity to the mattress.

A person sleeping on mattresses such as those described in the Chaffee and Hsu patents still has the perception of sleeping on the floor. Furthermore, getting into and out of such a bed can be difficult, especially for an elderly or disabled person.

A solution to this problem is to provide a mattress that approximates the dimensions of a traditional bed. But, such inflatable mattresses have a propensity to roll over. Rollovers are not only a problem with inflatable mattresses, but with all lightweight support surfaces, such as inflatable furniture. Some in the prior art, such as U.S. Pat. No. 6,161,902, issued to Marvin S. Lieberman on Dec. 19, 2000 (the Lieberman patent) and the "Retro Air Chair" by Intex Recreation Corporation of Long Beach, Calif., have used multiple inflatable cylindrical tubes to improve the stability of inflatable chairs.

While the stabilization methods employed in the prior art can improve overall chair stability, each has shortcomings, especially when applied to other support systems. For example, the Lieberman patent teaches the installation of a "U" shaped inflatable tube underneath the front of a chair and a small inflatable tube extending along and immovably attached to the rear base of the chair. Each of these tubes is also inflated separately from and to a higher pressure than the body of the chair. The increased pressure of these tubes strengthens the base of the chair, thus reducing the likelihood of rollover. While this approach has some merit, the introduction of separately inflatable tubes means added work for the consumer, who must move an inflation device from one valve to another until the chair is properly filled.

The Retro Air Chair applies an alternative stabilization technique. Two small inflatable stabilizer bars, no more than fifteen inches long and approximately six inches in diameter when inflated, are attached to the base of the chair to increase the surface area covered by the chair. These stabilizer bars are attached to the chair through narrow, short inflator tubes. The inflator tubes allow the stabilizer bars to be in fluid communication with the chair body and to fill with air as the chair is filled. The increased surface area created by the combination of the inflator tubes and the stabilizer bars provides more stability by distributing the weight over a larger area.

As with the Lieberman patent, the shape and position of the stabilizer bars employed on this chair also strengthens the chair body where the stabilizer bars contact the chair. However, such strengthening is only provided to areas adjacent to the tubes. While this may be practical for inflatable support systems with smaller weight bearing surfaces, such as chairs, a few, relatively short stabilizer bars will not provide stability for larger inflatable support systems, such as inflatable mattresses.

An additional problem faced by inflatable support systems of the prior art is structural stability of the sides of the support system. The shape of the sides tends to distort as weight is applied at or near the edge of the support system. Such distortion can cause a person to slip or fall from the support surface, increasing the risk of injury to a user. This problem becomes increasingly significant as the height of the support system is increased. A means of improving the structural stability of the side of the mattress is therefore preferable as height is increased.

SUMMARY OF THE INVENTION

An inflatable mattress is provided. The inflatable mattress comprises a support system having upper and lower inflatable support chambers arranged in a substantially vertical manner. Each inflatable support chamber comprises a top layer and a bottom layer. The inflatable mattress further comprises an inflatable reinforcing chamber disposed between the upper and lower inflatable support chambers and attached to the lower inflatable support chamber.

In an alternative embodiment, an inflatable mattress is provided. The inflatable mattress comprises a support system comprising upper and lower inflatable support chambers arranged in a substantially vertical manner, each inflatable support chamber comprising a top layer and a bottom layer. The support system further comprises an inflatable reinforcing chamber disposed between the upper and lower inflatable support chambers and attached to the upper inflatable support chamber.

In a third alternative embodiment, an inflatable mattress is provided. The inflatable mattress comprises a support system comprising upper and lower inflatable support chambers arranged in a substantially vertical manner, each inflatable support chamber comprising a top layer, a bottom layer and an outer perimeter. An inflatable reinforcing chamber is disposed between the upper and lower inflatable support chambers. At least a portion of said outer perimeter of the bottom layer of the upper inflatable support chamber and at least a portion of the outer perimeter of the top layer of the lower inflatable support chambers is in contact with the inflatable reinforcing chamber.

BRIEF DESCRIPTION OF THE DRAWINGS

The accompanying drawings which are included to provide a further understanding of the invention and are incorporated in and constitute a part of this specification, and illustrate embodiments of the invention and together with the description serve to explain the principles of the invention.

In the drawings:

FIG. 3 is a front planar view of the mattress embodiment of FIG. 1;

FIG. 4 is a rear planar view of the mattress embodiment of FIG. 1;

DETAILED DESCRIPTION OF THE PREFERRED EMBODIMENTS

Reference will now be made in detail to the preferred embodiments, examples of which are illustrated in the accompanying drawings.

Figure 1:
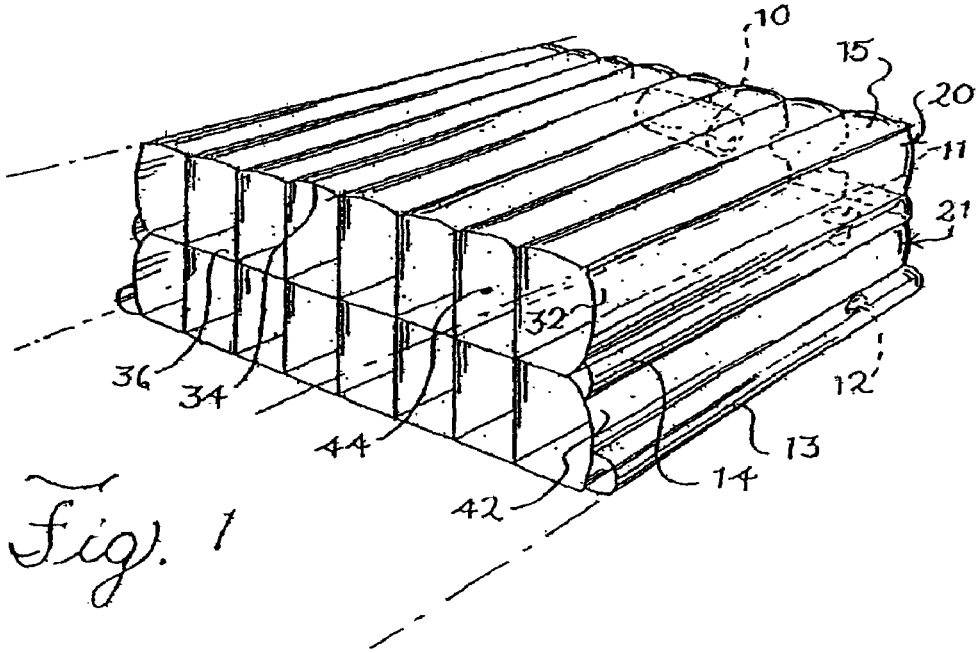
FIG. 1 is a perspective view of the internal structure of a mattress embodiment.
Figure 7:
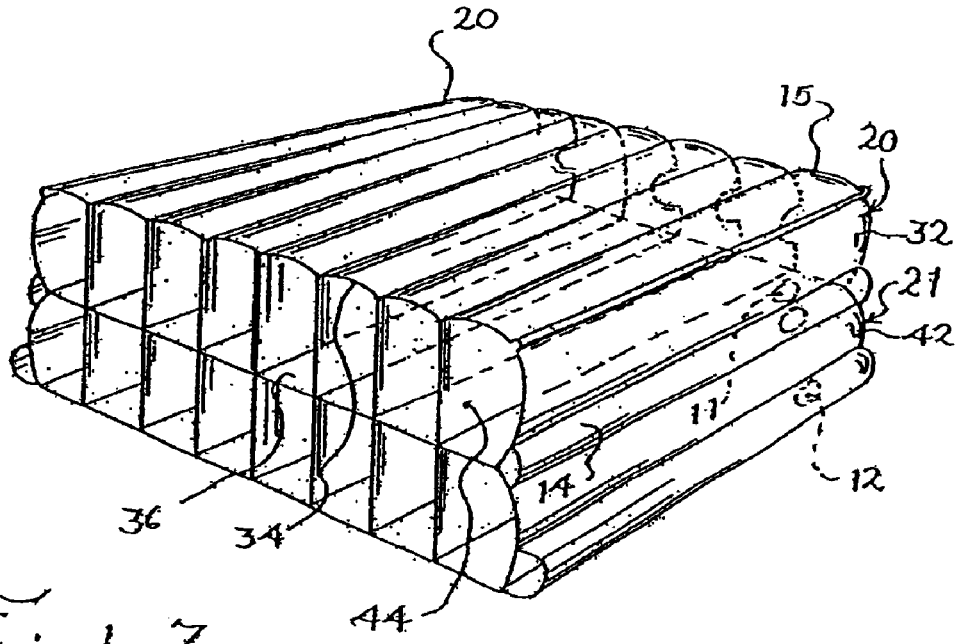
FIG. 7 is a perspective view of an alternative mattress embodiment employing multiple upper support chambers.

FIG. 1 is a perspective view of the internal structure of an inflatable mattress embodiment. FIG. 1 illustrates an embodiment comprising an inflatable support system including two support chambers 20, 21, stacked vertically. In the embodiment illustrated in FIG. 1, the upper support chamber 20 is constructed with side gussets 32 approximately ten inches high, which connect to top 34 and bottom 36 layers. The lower support chamber 21 is constructed from a top layer 38, a bottom layer 40 and a side gusset 42 that is approximately fifteen inches high. It should be clear to one skilled in the art that alternative side gusset heights and chamber arrangements could be substituted without departing from the spirit and scope of the present invention. By way of example, FIG. 7 illustrates the use of multiple upper support chambers. As is more clearly shown in FIG. 9, the upper support chamber 20 rests on top of the lower support chamber 21. The top layer 38 of the lower support chamber 21 is in contact with the bottom layer 36 of the upper support chamber 20.

As FIG. 1 illustrates, a motorized pump 10 is attached to upper support chamber 20. The pump 10 should be powerful enough to fill the entire support system with a gas or fluid, such as air, such that the upper support chamber 20 can provide comfortable support to a user. Inflation of the support system can begin by pressing a button 23 on or near the pump 10, as is illustrated in FIG. 3. The pump 10 may automatically stop inflating the support system when the pressure within the support system reaches a limit selectable by a user. In addition, should a user desire to gradually decrease the pressure within the support system, a user simply activates a push-button valve 27, illustrated in FIG. 3. The pump 10 may also monitor support system air pressure and automatically add additional air if the pressure falls below a level selected by a user.

Air entering the upper support chamber 20 may flow into the lower support chamber 21 through a series of reinforced openings 11. These openings 11 are defined in the top layer 38 of the lower support chamber 21 and the bottom layer 36 of the upper support chamber 20. The openings 11 are substantially aligned such that air may flow between them. In the embodiment illustrated in FIG. 1, additional openings 12 allow the inflatable stabilizing components 13 to be in fluid communication with the lower support chamber 21.

Figure 9:
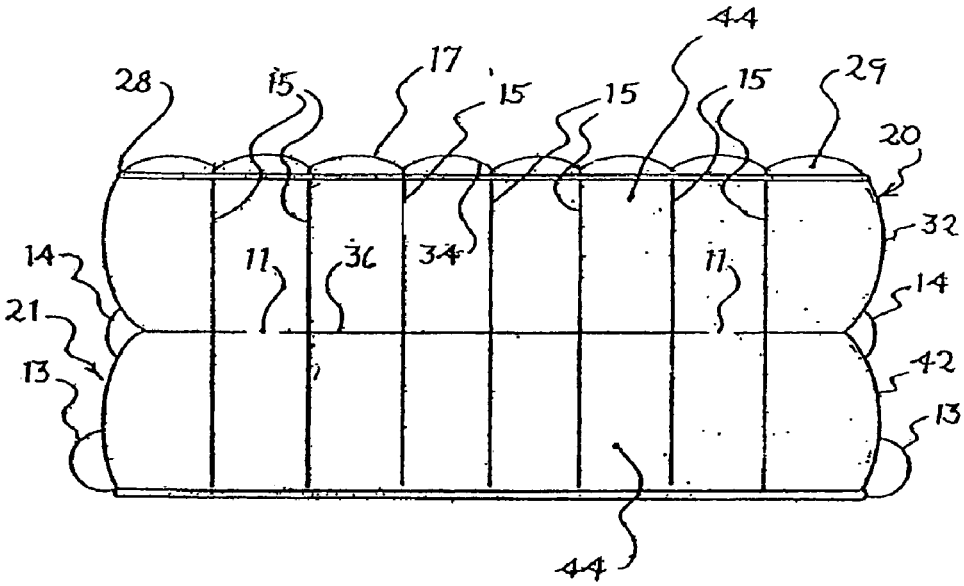
FIG. 9 is a cross-sectional view of the mattress embodiment of FIG. 4 including a pillow-top chamber.
Figure 10:
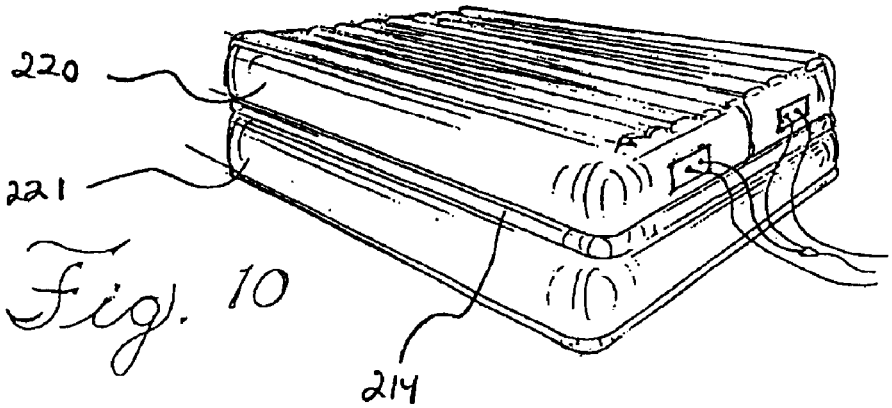
FIG. 10 is a perspective view of a mattress embodiment illustrating an inflatable reinforcing chamber positioned between the upper and lower inflatable support chambers.
Figure 11:
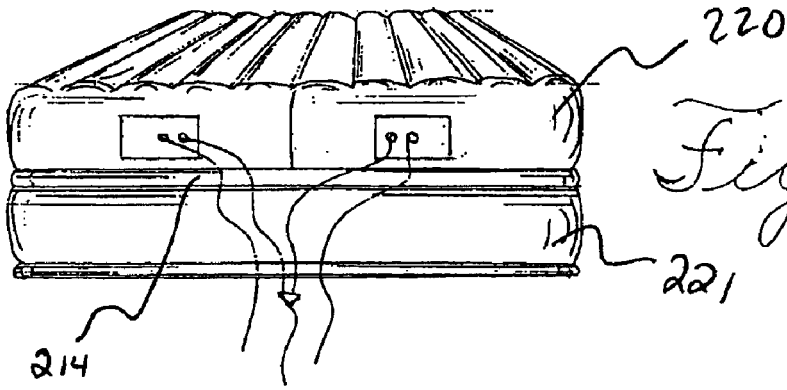
FIG. 11 is a side view of the embodiment of FIG. 10.
Figure 12:
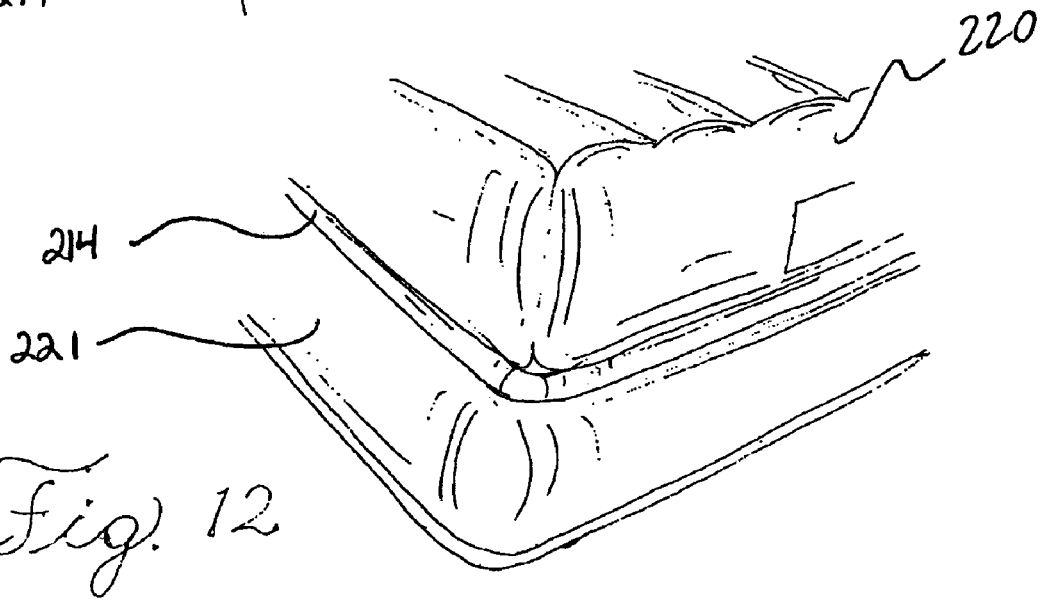
FIG. 12 is a close up view of the inflatable reinforcing chamber of FIG. 10.

Additionally, a reinforcing chamber 14 is included in the support system. The reinforcing chamber 14 is best illustrated in FIG. 9. This reinforcing chamber 14 runs circumferentially around the support system at the junction between the upper support chamber 20 and the lower support chamber 21. The reinforcing chamber 14 may be attached to the side gussets 32, 42 of the upper 20 and lower 21 inflatable support chambers, respectively.

Again referring to FIG. 1, the upper support chamber 20, lower support chamber 21, inflatable stabilizing component (s) 13, and reinforcing chamber 14 are preferably made from heavy weight (preferably 18 gauge) polyvinylchloride (PVC) or other watertight and airtight material. PVC may be attached to PVC or other material by electronically "welding" the PVC to the other material, although other attachment means, such through a chemical bond or by stitching edges of each sheet together, may also be used. Such an attachment means may be used, for example, to join the top of a chamber with the side of a chamber or to add a layer of fabric, padding, flocking, or other material (collectively "fabric") to the PVC.

Within the upper support chamber 20 and the lower support chamber 21, PVC strips 15 can be attached to the inner surface of the top layer 34, 38 and bottom layer 36, 40 of each chamber 20, 21. Such PVC strips 15 create elongated parallel channels 44, which help to shape and structurally reinforce the upper support chamber 20 and the lower support chamber 21. It should be apparent to one skilled in the art that alternative chamber support architectures, such as the "coil construction" technique known in the art, may be employed without departing from the spirit or scope of the present invention.

Figure 2:
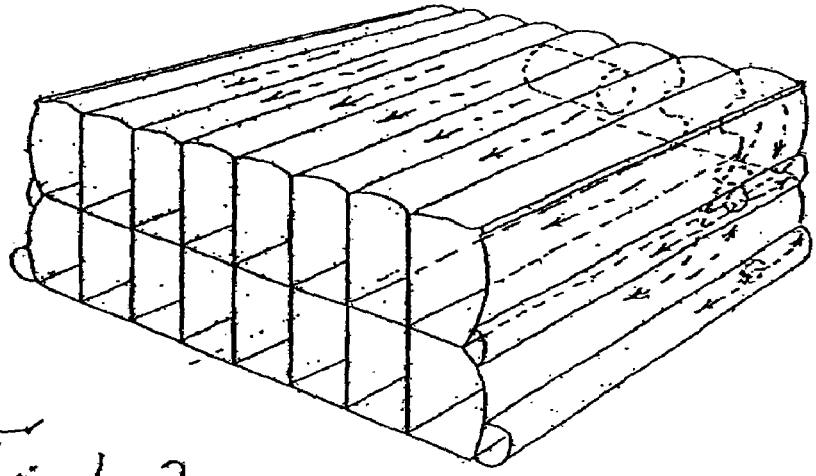
FIG. 2 is a perspective view of the internal structure of the mattress embodiment of FIG. 1 also illustrating air flow inside said mattress.

FIG. 2 is a perspective view of the internal structure of a mattress embodiment also illustrating the flow of air or other fluid inside said mattress. As FIG. 2 illustrates, air enters the support system at the pump 10 and travels through the channels 44 created by PVC strips 15 within the upper support chamber 20. The PVC strips 15 are preferably shaped such that air is able to flow past the ends of the PVC strips 15, thereby allowing air to circulate within the upper support chamber 20 and the lower support chamber 21.

As the upper support chamber 20 inflates, air can enter the lower support chamber 21 through the openings 11. The embodiment shown uses four such openings 11, each of which is approximately three quarters of an inch in diameter. Each opening 11 is substantially centered within a circular weld four inches in diameter, where such a weld can also serve to attach the upper support chamber 20 to the lower support chamber 21. It should be obvious to one skilled in the art that other opening arrangements, including, but not limited to, fewer openings of a larger size, or more openings of a smaller size, may also be used.

While such alternative opening arrangements may be used, a preferred placement of the openings 11 is important for proper durability and inflation. Locating the openings 11 in the second channel from the end has proved to generate the least number of tears in the PVC strips 15 while still allowing rapid inflation of both the upper support chamber 20 and the lower support chamber 21.

Figure 8:
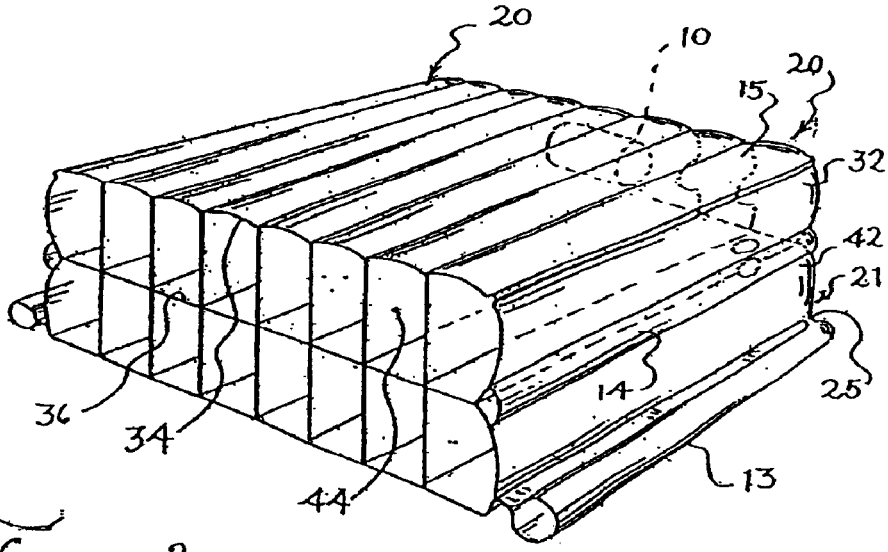
FIG. 8 is a perspective view of an alternative mattress embodiment in which the illustrated stabilizer bar is in fluid communication with the lower support chamber through a series of tubes.

As the lower support chamber 21 inflates, air can also flow into the stabilizing component(s) 13. The stabilizing component(s) 13 are preferably of a height less than that of the lower support chamber 21. In the embodiment illustrated in FIG. 2, air can flow into and out of the stabilizing component(s) 13 through a series of openings 12. FIG. 8 illustrates a preferred stabilizing component 13 embodiment, in which the stabilizing component(s) 13 are bars that are in fluid communication with the lower support chamber 21 through two short tubes 25. While the position of the tubes 25 does not impact the ability of the stabilizing component(s) 13 to inflate, in the embodiment shown, the tubes 25 are preferably located approximately one and one half inches from the ends of the stabilizing component(s) 13.

As illustrated in both FIG. 2 and FIG. 8, the stabilizing component(s) 13 are flexibly attached to the side gusset 42 of the lower support chamber 21, preferably near the bottom of the side gusset 42. Alternatively, the stabilizing component(s) 13 may be attached directly to the bottom layer 40 of the lower support chamber 21. In the embodiments shown, the stabilizing component(s) 13 are attached to opposite sides of the lower support chamber 21.

Figure 6:
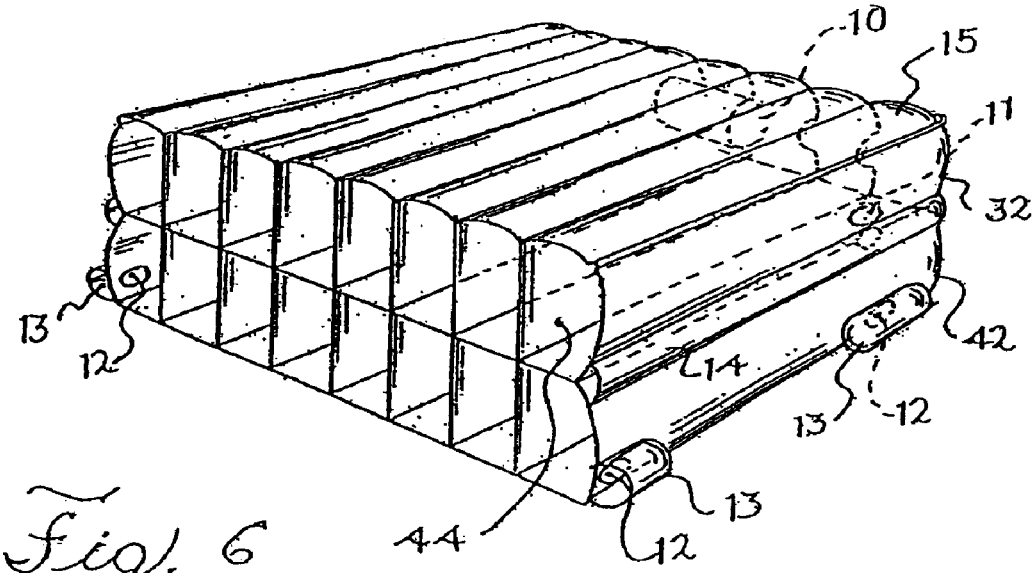
FIG. 6 is a perspective view of an alternative mattress embodiment employing multiple stabilizer bars.

While FIG. 2 illustrates the use of a single stabilizing component 13 on opposing sides of the support system, each having of a length substantially equal to the length of the support system, alternative stabilizing component arrangements can also be envisioned. For example, FIG. 6 provides an alternative perspective view of a mattress embodiment employing multiple stabilizing component(s) 13 on each opposing side of the support system. In another alternative embodiment, a single stabilizing component can extend circumferentially around the lower support chamber 21. Such a stabilizing component can be a series of smaller stabilizing component(s) in fluid communication with each other, or a single stabilizing component. It should be noted that, unlike the stabilizer bars used in the prior art, the stabilizing component arrangements employed in the present embodiments provide stabilization along almost the entire length of at least one side of the support system.

FIG. 2 also illustrates a preferred inflation means for the reinforcing chamber 14. As FIG. 2 illustrates, the reinforcing chamber 14 is in fluid communication with the lower support chamber 21 through a series of openings 16 and runs circumferentially around the support system. In a preferred embodiment, the openings 16 are approximately three quarters of an inch in diameter, and are substantially centered in reinforced PVC.

In an alternative embodiment, the reinforcing chamber 14 may receive air from the upper support chamber 20. In still another embodiment, the reinforcing chamber 14 may be in fluid communication with both the upper support chamber 20 and the lower support chamber 21. In yet another embodiment, the reinforcing chamber 14 may be separately inflatable, thereby allowing the reinforcing chamber 14 to be inflated to a pressure greater than the pressure in the remaining support system.

FIG. 3 is a front planar view of a mattress embodiment. As FIG. 3 illustrates an embodiment with one or more layers of fabric 17 added to the outside of the upper support chamber 20. While it is preferred that the fabric 17 be laminated to the upper support chamber 20, additional attachment means, such as, but not limited to, chemical adhesives, electronic welding, or sewing, may also be used.

Figure 5:
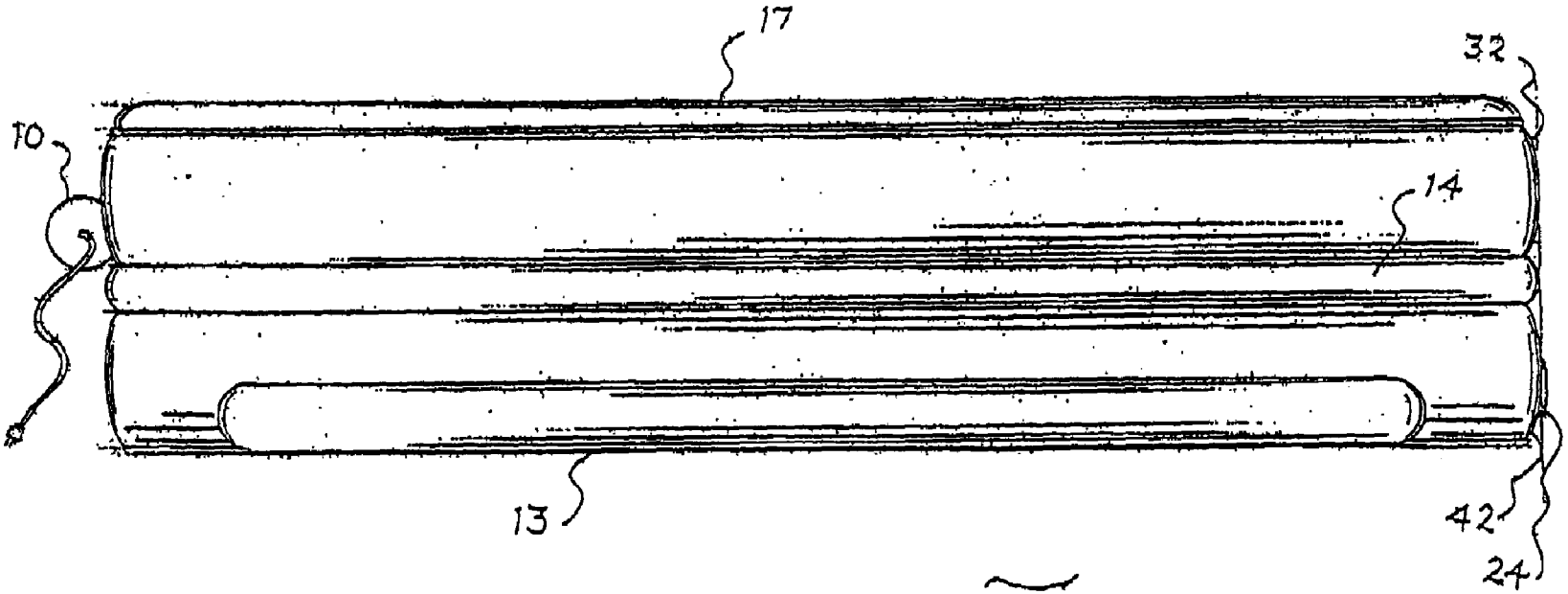
FIG. 5 is a side planar view of the mattress embodiment of FIG. 1.

FIG. 4 is a rear planar view of a mattress embodiment showing the valve 24. In the embodiment illustrated in FIG. 4, the valve 24 is located substantially in the center of the lower support chamber 21 at the end opposite from which the pump 10 is attached to the upper support chamber 20. This arrangement is preferred, as it allows more of the weight of the support system to force air through the valve 24. This, in turn, allows the support system to be quickly deflated for storage. The arrangement of the valve 24 with respect to the pump 10 is more clearly illustrated in FIG. 5.

FIG. 7 is an alternative perspective view of a mattress embodiment, illustrating the use of multiple upper support chambers 20. In the embodiment illustrated in FIG. 7, the upper support chambers 20 can be in fluid communication with the lower support chamber 21. In an alternative embodiment, the upper support chambers 20 may be separately inflatable, allowing users to select a desired firmness for each upper support chamber. In this embodiment, air from pump 10 may be redirected into either or both the upper support chambers 20 by enabling or disabling one or more valves 26 connected to each chamber (illustrated in FIG. 3).

FIG. 9 is a cross-sectional view of the mattress embodiment illustrated in FIG. 4 with the addition of a pillow-top chamber 29. In this embodiment, the pillow-top chamber 27 does not have a side gusset, which results in a rounded outer edge 28. In addition, the pillow-top chamber 27 has dimensions substantially equal to those of the upper support chamber 20. The pillow-top chamber 27 can also be welded to give it a quilted appearance, and it can be covered with flocking or other material to provide a soft texture. Through the addition of such a pillow-top chamber 27, support system as a whole can more closely approximate the look and feel of a traditional bed.

An inflatable mattress incorporating an alternative embodiment of an inflatable reinforcing chamber is illustrated in FIGS. 10-16. For consistency, reference numbers for FIGS. 10-16 correspond to the reference numbers in FIGS. 1-9 with the addition of a leading "2". In this embodiment, an inflatable reinforcing chamber 214 is provided between the upper 220 and lower 221 inflatable support chambers as opposed to being attached to the side gussets 32, 42 of the upper 20 and lower 21 inflatable support chambers as in the previous embodiments.

The inflatable reinforcing chamber 214 can be attached to the upper 220 and/or lower 221 inflatable support chambers through any means known in the art such as such as electronic or sonic "welding," heat welding, chemical adhesives or other methods known in the art. It can also take alternative shapes in cross section, such as trapezoidal or square as opposed to the tubular shape as illustrated. In operation, when inflated, the inflatable reinforcing chamber 214 prevents the sides of the upper inflatable support chamber 220 from collapsing when weight is applied to the inflatable mattress. This prevents a user from rolling off of the side of the inflatable mattress.

Figure 13:
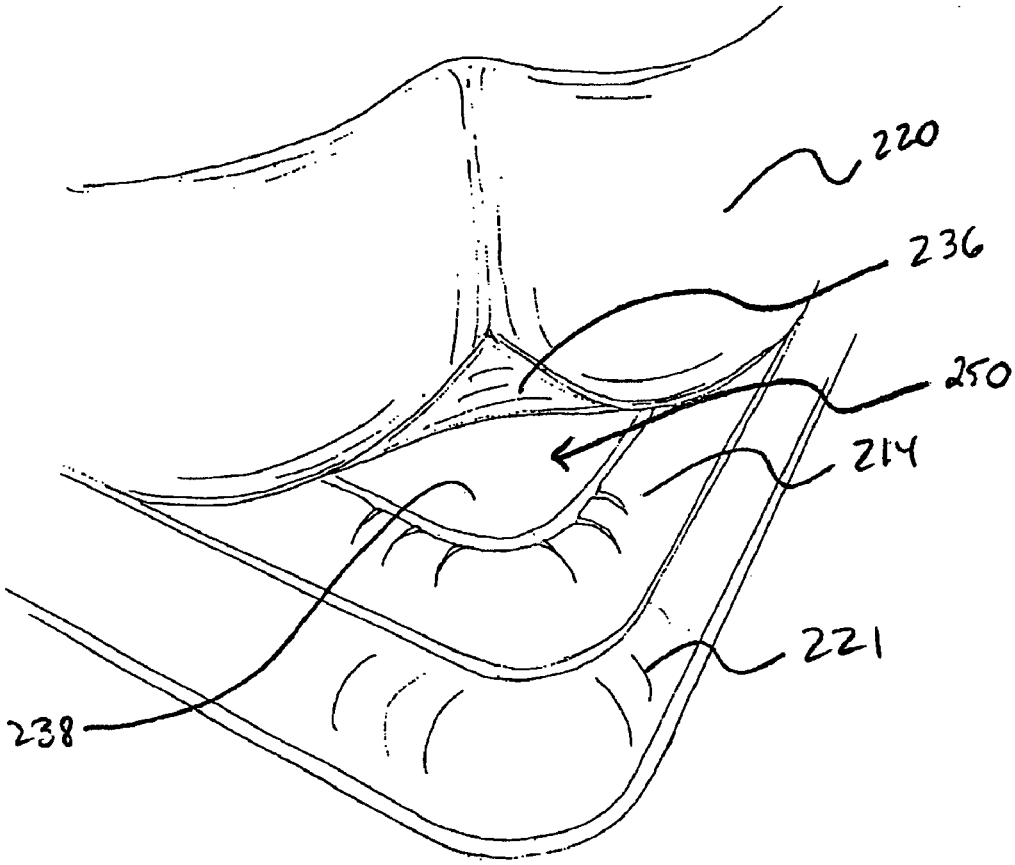
FIG. 13 is an alternative close up view of the inflatable reinforcing chamber of FIG. 10 showing the upper chamber separated from the inflatable reinforcing chamber.

The inflatable reinforcing chamber 214 is preferably substantially tubular in cross section and preferably has an outer perimeter that substantially matches the outer perimeters of the upper 220 and lower 221 inflatable chambers. This arrangement is illustrated in FIG. 13, wherein the upper inflatable support chamber 220 has been pulled back to reveal the structure of the inflatable reinforcing chamber 214 at one of the corners of the inflatable mattress. The inflatable reinforcing chamber 214 is preferably positioned underneath the upper inflatable support chamber 220 such that upon inflation of the upper inflatable support chamber 220, lower inflatable support chamber 221, and reinforcing chamber 214, the upper and lower inflatable support chambers 220, 221 are not in substantial contact with each other at least around their respective outer perimeters. The inflatable reinforcing chamber 214 is preferably of a height less than the heights of the upper 220 and lower 221 inflatable support chambers.

Figure 14:
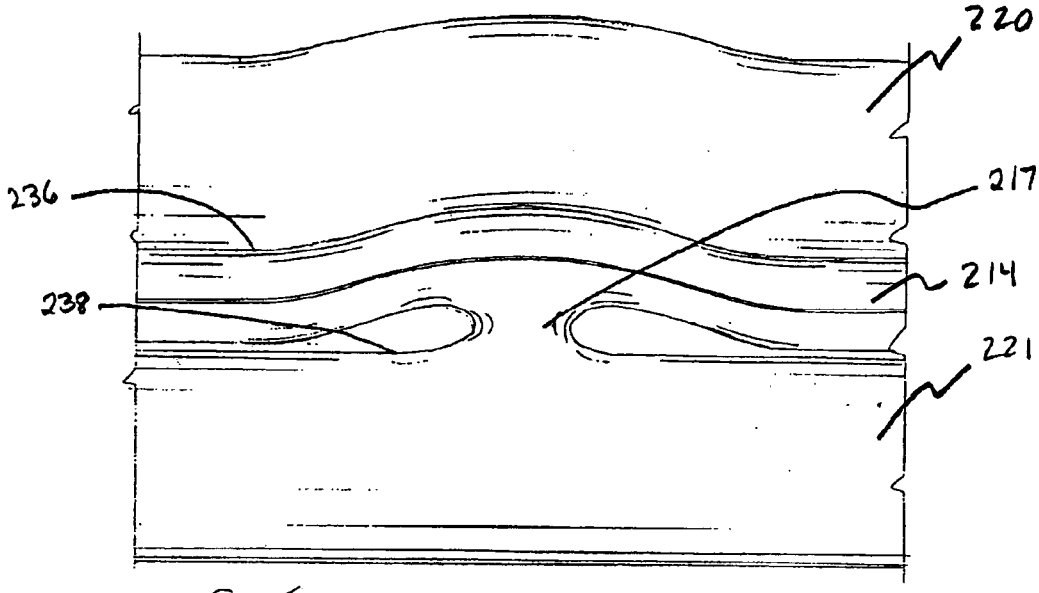
FIG. 14 is a close up side view of the inflatable reinforcing chamber of FIG. 10, illustrating the connection between the inflatable reinforcing chamber and the lower inflatable support chamber.
Figure 15:
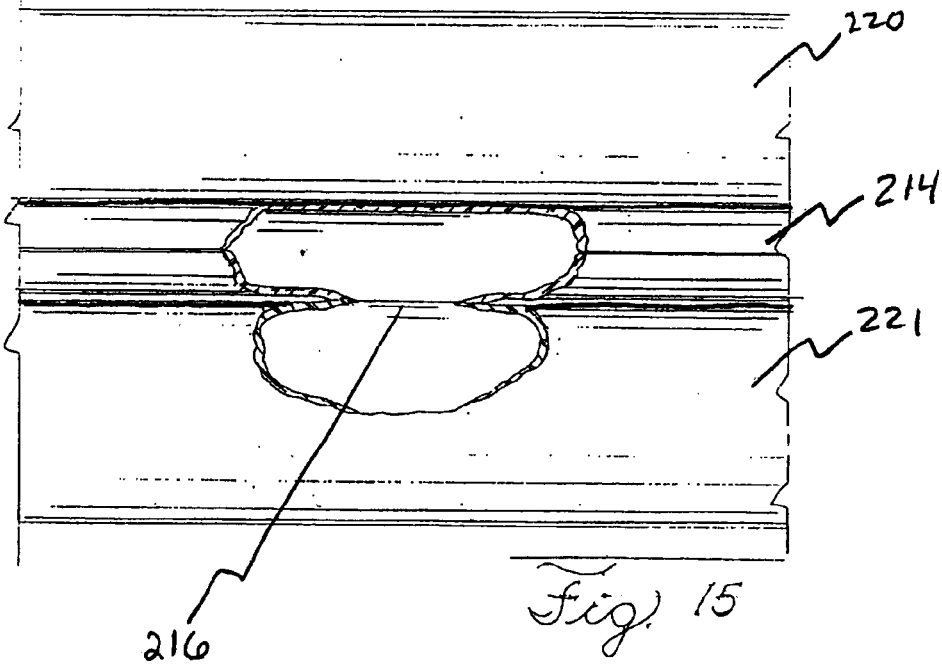
FIG. 15 is a cut away view of the connection of FIG. 14.
Figure 16:
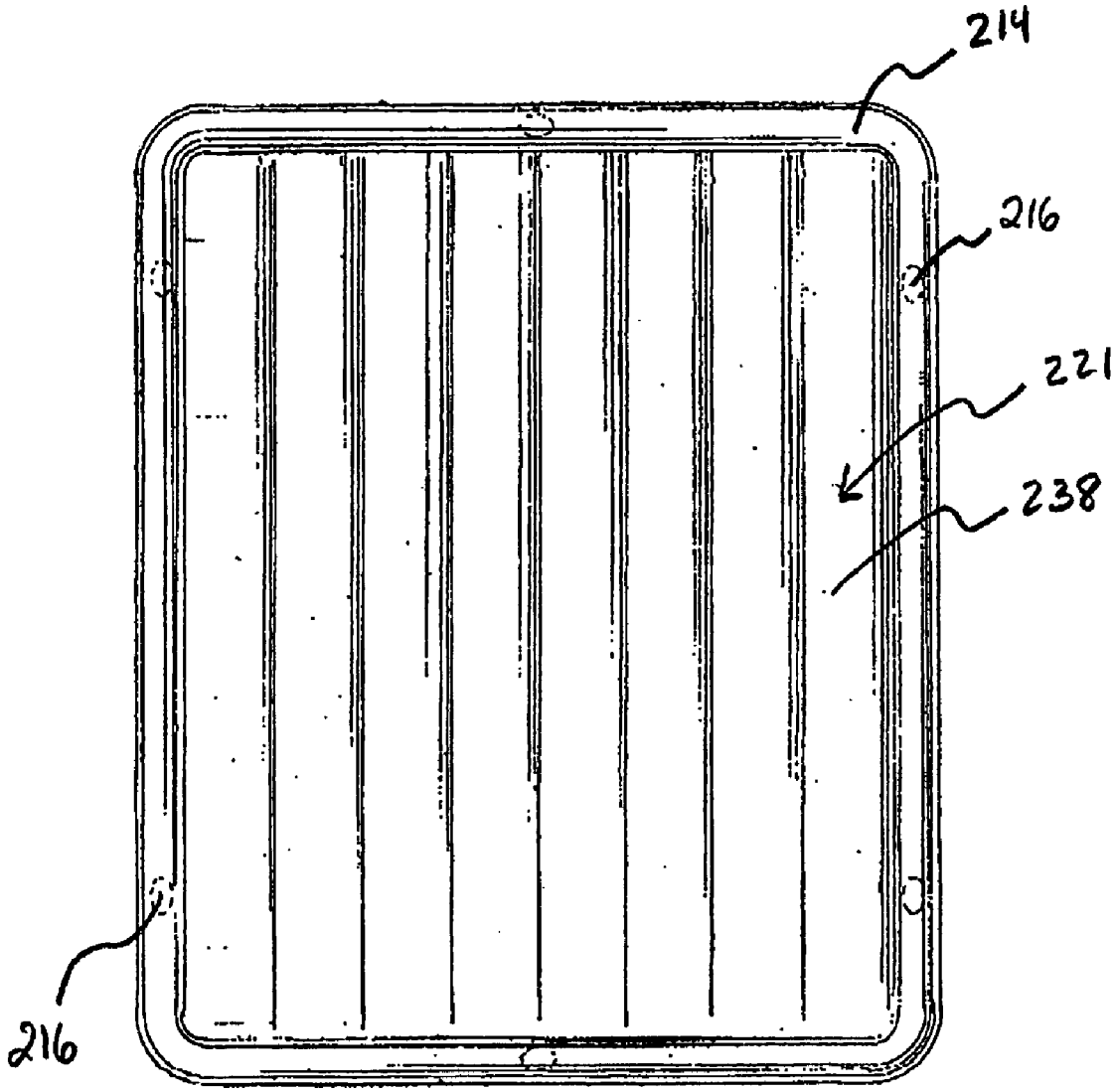
FIG. 16 is a top plan view of the mattress embodiment of FIG. 10 with the upper inflatable support chamber removed.

Referring to FIGS. 14 and 15, the inflatable reinforcing chamber 214 is preferably attached to the top layer 238 of the lower inflatable support chamber 221. An opening 216 is defined in the lower inflatable support chamber 221 and an opening 216 is defined in the inflatable reinforcing chamber 214. These openings 216 are aligned and the top layer 238 of the lower inflatable support chamber 221 is attached to the inflatable reinforcing chamber 214 through electronic or sonic "welding," heat welding, chemical adhesives or other methods of attachment known in the art. If desired, reinforcing material (not shown) can be welded or otherwise attached around the openings 216 to further strengthen them. The aligned openings 216 form a channel 217 between the inflatable reinforcing chamber 214 and the lower inflatable support chamber 221 to provide fluid communication between the chambers 214, 221.

Furthermore, a plurality of such openings 216 and corresponding channels 217 may be provided to increase fluid communication between the chambers 214, 221. Moreover, the same arrangement can be used to provide fluid communication between the upper inflatable support chamber 220 and the inflatable reinforcing chamber 214. In such an embodiment, corresponding openings 216 are provided in the bottom layer 236 of the upper inflatable support chamber 220 and the inflatable reinforcing chamber 214. Additionally, as described in the previous embodiments, the upper 220 lower 221 inflatable support chambers may have openings 11 to provide fluid communication between the upper 220 and lower 221 inflatable support chambers.

If openings 216 between the inflatable reinforcing chamber 214 and either or both of the upper and/or lower inflatable support chambers 220, 221 are not provided, the inflatable reinforcing chamber 214 may be separately inflated from the upper 220 and lower 221 inflatable support chambers. In that case, the inflatable reinforcing chamber 214 would include a valve for inflation and/or deflation. Alternatively, it could incorporate separate valves for inflation and deflation. In the embodiment shown in the figures, the inflatable reinforcing chamber 214 is in direct fluid communication with the lower 221 inflatable support chamber 221 and the lower inflatable support chamber 221 is in direct fluid communication with the upper inflatable support chamber 220 through openings 11 as described with respect to the embodiments shown in FIGS. 1-9. This allows one valve or pump to provide an inlet to inflate all of the chambers 214,220,221.

Alternatively, if the inflatable reinforcing chamber 214 is in fluid communication with both the upper 220 and lower 221 inflatable support chambers, the openings 11 directly between the upper 220 and lower 221 inflatable support chambers can be eliminated. Instead, the inflatable reinforcing chamber 214 preferably has at least one opening 216 to the upper inflatable support chamber 220 and at least one opening 216 to the lower inflatable support chamber 221. Alternate arrangements of openings 216 between the upper 220, lower 221 and inflatable reinforcing chamber 214 can be provided utilizing more or fewer openings 216. Furthermore, the inflatable reinforcing chamber 214 can be attached to the upper 220 and/or lower 221 inflatable support chambers at locations other than at the openings 216 through electronic or sonic "welding," heat welding, chemical adhesives or other methods of attachment known in the art.

Additionally, the upper 220 and lower 221 inflatable support chambers can be arranged such that, upon inflation of the mattress, they are no longer in substantial contact with each other until weight is applied to the upper inflatable support chamber 220. In such an embodiment, the upper inflatable support chamber 220 is in contact with the inflatable reinforcing chamber 214 around the outer perimeter of the upper inflatable support chamber 220. The lower inflatable support chamber 221 is similarly in contact with the inflatable reinforcing chamber 214 around the outer perimeter of the lower inflatable support chamber 221. As best illustrated in FIG. 13, when the chambers 214, 220, 221 are inflated, a space 250 is formed between the upper 220 and lower 221 inflatable support chambers in the middle section of the upper 220 and lower 221 inflatable support chambers. When a user sits or lies on the inflatable mattress, the middle sections of the upper 220 and lower 221 inflatable support chambers may come into substantial contact with each other. Furthermore, in such an embodiment, the inflatable reinforcing chamber 214 is movable relative to the upper inflatable support chamber 220 and the lower inflatable support chamber 221. FIG. 13 shows the inflatable reinforcing chamber 214 separated from the upper inflatable support chamber 220.

Through the arrangements set forth above, the present invention provides an increased height inflatable support system that yields increased comfort, added stability, and improved structural integrity over the prior art.

It should be noted that there could be a wide range of changes made to the present embodiments without departing from the scope of the claimed invention. For example, more support chambers could be added, the size of the chambers could be changed, and other types of inflation methods could be utilized. It is therefore intended that the foregoing detailed description be regarded as illustrative rather than limiting, and that it be understood that it is the following claims, including all equivalents, that are intended to define the spirit and scope of this invention.

What is claimed is:

1. An inflatable mattress comprising:

a support system comprising an upper and a lower inflatable support chamber arranged in a substantially vertical manner, each inflatable support chamber comprising a top layer and a bottom layer; and an inflatable reinforcing chamber disposed between said upper and lower inflatable support chambers and being attached to said lower inflatable support chamber, wherein said inflatable reinforcing chamber comprises a substantially tubular shape in cross section.

2. The inflatable mattress of claim 1, wherein said inflatable reinforcing chamber is attached to said top layer of said lower inflatable support chamber.

3. The inflatable mattress of claim 2 wherein said inflatable reinforcing chamber comprises an outer perimeter substantially matching the outer perimeters of said upper and said lower inflatable support chambers.

4. The inflatable mattress of claim 3, further comprising at least one opening defined in said inflatable reinforcing chamber and at least one opening defined in said lower inflatable support chamber, said openings being substantially aligned with each other and forming a channel providing fluid communication between said inflatable reinforcing chamber and said lower inflatable support chamber.

5. The inflatable mattress of claim 4, wherein a plurality of said openings are defined in said inflatable reinforcing chamber and a plurality of said openings are defined in said lower inflatable support chamber, said openings forming a plurality of said channels providing fluid communication between said inflatable reinforcing chamber and said lower inflatable support chamber.

6. The inflatable mattress of claim 1, wherein said inflatable reinforcing chamber is attached to said bottom layer of said upper inflatable support chamber.

7. The inflatable mattress of claim 6, wherein said upper inflatable support chamber, said lower inflatable support chamber and said inflatable reinforcing chamber are in fluid communication.

8. The inflatable mattress of claim 1, wherein said inflatable reinforcing chamber is of a height less than the height of said upper inflatable support chamber.

9. The inflatable mattress of claim 1, wherein said inflatable reinforcing chamber is of a height less than the height of said lower inflatable support chamber.

10. The inflatable mattress of claim 1, wherein said upper inflatable support chamber is attached to said lower inflatable support chamber.

11. The inflatable mattress of claim 10, further comprising at least one opening defined in said upper inflatable support chamber and at least one opening defined in said lower inflatable support chamber, said openings being substantially aligned with each other and forming a channel providing fluid communication between said upper inflatable support chamber and said lower inflatable support chamber.

12. The inflatable mattress of claim 11, wherein a plurality of said openings are defined in said upper inflatable support chamber and a plurality of said openings are defined in said lower inflatable support chamber, said openings forming a plurality of said channels providing fluid communication between said upper inflatable support chamber and said lower inflatable support chamber.

13. An inflatable mattress comprising:

a support system comprising an upper and a lower inflatable support chamber arranged in a substantially vertical manner, each inflatable support chamber comprising a top layer and a bottom layer; and an inflatable reinforcing chamber disposed between said upper and lower inflatable support chambers and being attached to said upper inflatable support chamber, wherein portions of said inflatable reinforcing chamber are movable relative to at least one of said upper and said lower inflatable support chambers.

14. The inflatable mattress of claim 13, wherein said inflatable reinforcing chamber is attached to said bottom layer of said upper inflatable support chamber.

15. An inflatable mattress comprising:

a support system comprising an upper and a lower inflatable support chamber arranged in a substantially vertical manner, each inflatable support chamber comprising a top layer, a bottom layer and an outer perimeter; and an inflatable reinforcing chamber disposed between said upper and lower inflatable support chambers, at least a portion of said outer perimeter of said bottom layer of said upper inflatable support chamber and at least a portion of said outer perimeter of said top layer of said lower inflatable support chambers being in contact with said inflatable reinforcing chamber; and at least one substantially fluid impermeable channel defined between said lower inflatable support chamber and said inflatable reinforcing chamber to provide fluid communication between said lower inflatable support chamber and said inflatable reinforcing chamber.

16. The inflatable mattress of claim 15, wherein said inflatable reinforcing chamber is attached to said upper inflatable support chamber.

17. The inflatable mattress of claim 15 wherein said inflatable reinforcing chamber is attached to said lower inflatable support chamber.

* * * * *